US005316025A

United States Patent [19]

Sahm

[11] Patent Number: 5,316,025

[45] Date of Patent: May 31, 1994

[54] METHOD OF SET SHAPING HAIR

[76] Inventor: Jürgen E. Sahm, Baumgarten 21, 8905 Arni, Switzerland

[21] Appl. No.: 825,962

[22] Filed: Jan. 27, 1992

[30] Foreign Application Priority Data

Jan. 28, 1991 [CH] Switzerland ..... 245/91

[51] Int. Cl.[5] ..... A45D 7/02

[52] U.S. Cl. ..... 132/211; 132/227

[58] Field of Search ..... 132/204, 205, 206, 207, 132/210, 211, 227, 228, 229, 269, 272

[56] References Cited

U.S. PATENT DOCUMENTS

| | | | |
|---|---|---|---|
| 3,265,075 | 8/1966 | Edman et al. | 132/227 |
| 3,768,490 | 10/1973 | Kalopissis et al. | 132/203 |
| 3,802,442 | 4/1974 | Serdar | 132/228 |
| 3,990,460 | 11/1976 | Shalvoy | 132/271 |
| 4,215,709 | 8/1980 | Carr | 132/207 |
| 4,481,961 | 11/1984 | Bauer et al. | 132/206 |
| 4,610,261 | 9/1986 | Madrange et al. | 132/206 |
| 4,911,185 | 3/1990 | Losenno | 132/211 |
| 4,926,027 | 5/1990 | Wontagino et al. | 132/271 |
| 5,091,630 | 2/1992 | Djuric | 132/229 |

*Primary Examiner*—Gene Mancene
*Assistant Examiner*—Frank A. LaViola
*Attorney, Agent, or Firm*—Gordon W. Hueschen

[57] ABSTRACT

Firstly, a permanent wave agent is placed onto the hair and thereafter the hairs are laid into a treatment shape. This treatment shape is such that a subsequent aerating of the hair by means of warm air the hair is exposed to the warm air uniformly from the area of the tips of the hair to the area of the base of the hair. In order to produce, for instance, permanent waves the hair is wound to a treatment shape corresponding to a hollow cylinder, such that an acting onto the hair proceeds from the inner jacket and from the outer jacket as well of the hollow cylinder. After the warm air treatment the permanent wave agent is rinsed out and the hair is released to attain the desired, final shape. The method allows a fast, simple and considerate treatment of the hair, and it is possible to produce much larger curls than hitherto possible.

3 Claims, 1 Drawing Sheet

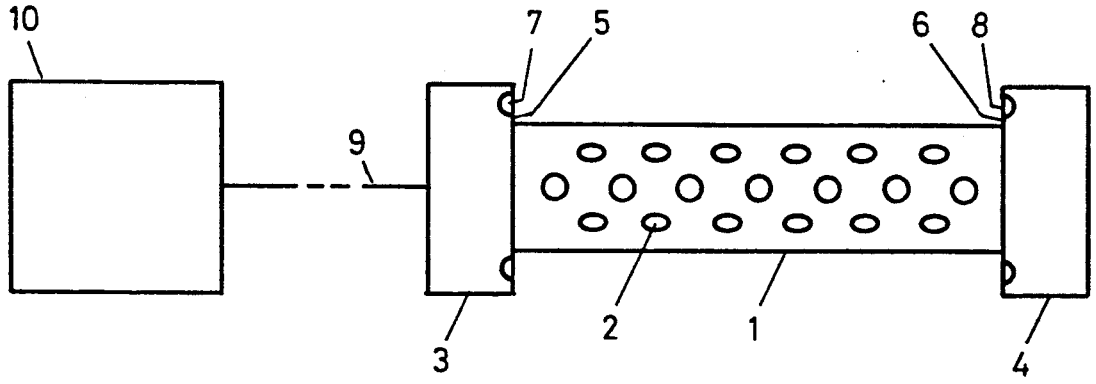
10
9
7
5
6
8
3
2
1
4

METHOD OF SET SHAPING HAIR

BACKGROUND OF THE INVENTION

1. Field of the Invention

The present invention relates to a method of a set shaping of hair. It also relates to an apparatus for practicing the method.

2. Description of the Prior Art

It is generally known to stretch natural curls of hair, to uncurl naturally curled hairs to a desired wave shape and also to lay straight hair to curls of varying sizes, i.e. to produce permanent waves by the use of suitable agents or liquids, respectively.

The hitherto commonly known methods can be performed only by a relatively large expenditure of time caused among others by the fact that the hair or strands of hair, respectively, which have been laid to a treatment form suitable for the treatment at elevated temperature are exposed to the airflows of elevated temperature to varying degrees such that no uniform acting by the warm air onto the hair seen in their longitudinal extent occurs and the result thereof is that the total time span for drying the hair is determined by the time span needed for drying those parts of the hair which consume the longest time. Conversely, those sections of the hair which dry first ar quite negatively influenced by the continued feed of the warm or hot, respectively, airflows which actually are no longer needed at those sections. Because it is necessary to dry the hair by means of highly heated air (hood 60° Celsius, hair blower 130° Celsius), a drying out of the skin of the head and of the hair is a result. These drawbacks are specifically obvious when it is taken into consideration that the strands of the hair, for instance, when producing permanent waves are wound around curlers, whereby the areas of the tips of the hair are located in the lowermost location of the wound hair strand and are insulated against the fed hot air by those hair layers lying on top of these lowermost tips. This fact causes also a limitation of the size of the curls of the hair which can be produced.

SUMMARY OF THE INVENTION

It is, therefore, a general object of the invention to provide a method for a set shaping of hair, by means of which it is possible to produce natural curls in a shorter time span by a simpler procedure and by a less harsh treatment for at least parts of the hair than until now possible, and by means of which larger curls can be produced as hitherto possible.

A further object is to provide a method of a set shaping of hair, comprising the steps of laying the hair into a treatment shape which depends on a desired final shape; placing a permanent wave agent onto the hair; aerating the hair by streams of warm air acting at least substantially uniformly onto the hair from the area of the tips of the hair to the area of the base of the hair; and of rinsing out the permanent wave agent and releasing the hair such to allow the hair to attain the desired, final shape.

BRIEF DESCRIPTION OF THE DRAWING

The invention will be better understood and objects other than those set forth above will become apparent when consideration is given to the following detailed description thereof. Such description makes reference to the annexed drawing, wherein:

The FIGURE shows schematically an apparatus for practicing the method.

DESCRIPTION OF THE PREFERRED EMBODIMENTS

The following exemplary description is based on the procedure of producing permanent waves. The hair which has previously possibly been washed is laid strand by strand into a treatment shape which depends on the desired final shape of e.g. the permanent waves. Thereafter a permanent wave agent is placed onto the strands. In order to produce permanent waves the hair is wound to the shape of a hollow cylinder, whereby depending from the fact if larger or smaller waves shall be produced the diameter of the hollow cylinder is selected accordingly to be larger or smaller. Thereafter jets of warm air are made to act upon the hair and the permanent wave agent placed thereupon and specifically in such a manner that the hair is exposed to the warm air from the area of the tips of the hair to the area of the base of the hair. The temperature of the warm air amounts maximal 45° Celsius, preferably 40°–42° Celsius, in order to prevent a complete drying out of individual sections of the hair or also of the skin of the head. The duration of this aerating amounts to 5–20 minutes.

An apparatus for practicing this aerating and specifically including a support for the hair wound therearound is illustrated in the FIGURE. The support includes a center section 1 having the shape of a hollow cylinder, onto which cylinder the hairs are wound. This hollow cylinder 1 includes through holes 2 perforating its sidewall. At both its sides the hollow cylinder 1 is closed off by close-off flanges 3, 4. In the illustrated embodiment these two close-off flanges 3, 4 are structured as hollow bodies, although for practicing the invention it would be merely necessary to have only one of the two flanges structured as hollow body, e.g. the flange located at the left hand side of the drawing. In the sidewalls 5 and 6, respectively, of the hollow close-off flanges 3, 4 which face the jacket portion of the hollow cylinder 1 further through holes 7 and 8, respectively, for the heated air are located. The support is connected, furthermore, via a flexible air feed hose 9 to an apparatus 10 which generates the requisite warm air. Obviously a plurality of such supports are used and each one of these supports is in communication with the common apparatus 10 and the diameter of the hollow cylinder and possibly also the shape of its circumference depend from the desired shape of the permanent waves to be produced.

It is now obvious that the tip areas of the hair which contact directly the jacket of the hollow cylinder 1 are exposed to the warm air jets flowing directly out of the through holes 2 and that the base sections of the hair wound around the support and which are located at the outside are exposed to the warm air jets exiting the through holes 7, 8 at the flanges such that a at least approximately uniform exposure of the hair along the entire longitudinal extent of the wound hair is arrived at.

Returning now to the method, the permanent wave agent is rinsed out of the hair after the warm air treatment by means of water and a neutralizing agent is placed onto the hair in accordance with known procedures. If necessary or desired, respectively, the hair is thereafter dried to a larger or a less extent and thereafter wound off the support.

Such as mentioned above, this method is faster, simpler than all known methods and is more considerate of the hair.

Furthermore it has been proven by means of practical tests that it is possible to produce permanent waves having much larger curls, i.e. curls having a larger diameter, than has been possible until now or has been held to be possible until now.

If the hair to be treated is relatively short and also depending from the number of curlers used, a given strand wound on a curler, i.e. on the treatment support, may not be that thick that the tips of the hair are shielded by hair sections covering the tips of the hair. In such case it is not necessary to have a support of which the hollow cylinder is perforated because in such case the tips of the hair would be exposed for too long a time to the warm airstream. Thus, a further embodiment includes a curler-like support of which the hollow cylinder 1 has no perforations and only at least one of the flanges 3, 4 has perforations in the sidewall facing the cylinder shaped support.

While there are shown and described present preferred embodiments of the invention, it is to be distinctly understood that the invention is not limited thereto, but may be otherwise variously embodied and practiced within the scope of the following claims.

I claim:

1. A method of a set shaping of hair, comprising the steps of laying the hair into a treatment shape which depends on a desired final shape;

placing a permanent wave agent onto the hair;

aerating the hair by streams of warm air acting at least substantially uniformly onto the hair from the area of the tips of the hair to the area of the base of the hair wherein the hair is aerated during the time span of 5–20 minutes by warm air;

rinsing out the permanent wave agent with water, placing a neutralizing agent onto the hair, drying the hair thereafter, and then releasing the hair to attain the desired, final shape, wherein the desired, final shape of the hair is a permanent wave, and wherein in order to lay the hair into a treatment shape the hair is rolled strand by strand to the shape of a hollow cylinder, and wherein the aerating is effected by a plurality of air jet streams, of which a first number of said air streams flow from the inner space of the hollow cylinder radially outwards and a second number of said air streams flow in the direction of the generatrix of the cylinder along the outer surface of the hollow cylinder.

2. The method of claim 1, wherein the aerating comprises a plurality of air jet streams flowing in the direction of the generatrix of the cylinder along the outer surface of the hollow cylinder.

3. The method of claim 1 wherein the maximum temperature of the warm air is approximately 45° Celsius.

* * * * *